US008960666B2

(12) United States Patent
Enderle et al.

(10) Patent No.: US 8,960,666 B2
(45) Date of Patent: Feb. 24, 2015

(54) METHOD AND DEVICE FOR THE GENERATION AND/OR CONVEYANCE OF A SHINGLED STREAM OF FLAT, FLEXIBLE OBJECTS

(71) Applicant: BDT Media Automation GmbH, Rottweil (DE)

(72) Inventors: Patrick Enderle, Rottweil (DE); Peter Kearney, Fridingen (DE); Andreas Wardak, Rottweil (DE)

(73) Assignee: BDT Media Automation GmbH, Rottweil (DE)

( * ) Notice: Subject to any disclaimer, the term of this patent is extended or adjusted under 35 U.S.C. 154(b) by 0 days.

(21) Appl. No.: 13/873,361

(22) Filed: Apr. 30, 2013

(65) Prior Publication Data

US 2013/0292894 A1 Nov. 7, 2013

(30) Foreign Application Priority Data

May 2, 2012 (DE) ..... 10 2012 207 285

(51) Int. Cl.

| | |
|---|---|
| ***B65H 29/32*** | (2006.01) |
| ***B65H 5/22*** | (2006.01) |
| ***B65H 29/66*** | (2006.01) |
| ***B65H 5/36*** | (2006.01) |

(52) U.S. Cl.

CPC ..... *B65H 5/224* (2013.01); *B65H 29/6609* (2013.01); *B65H 29/6654* (2013.01); *B65H 5/36* (2013.01); *B65H 2301/44734* (2013.01); *B65H 2301/44735* (2013.01); *B65H 2406/323* (2013.01); *B65H 2513/104* (2013.01); *B65H 2404/2691* (2013.01); *B65H 2406/36625* (2013.01); *B65H 2402/10* (2013.01); *B65H 2406/3124* (2013.01)

USPC ..... 271/197; 271/3.22; 271/183; 271/194

(58) Field of Classification Search

USPC ..... 271/3.22, 3.23, 276, 182, 183, 194, 271/196, 197; 414/793.1, 794.4

See application file for complete search history.

(56) References Cited

U.S. PATENT DOCUMENTS 4,647,033 A * 3/1987 Emrich ..... 271/276
4,805,890 A * 2/1989 Martin ..... 271/203

(Continued)

FOREIGN PATENT DOCUMENTS

DE 27 25 547 A1 12/1978
DE 41 39 888 A1 6/1993

(Continued)

*Primary Examiner* — Ernesto Suarez
(74) *Attorney, Agent, or Firm* — Leydig, Voit & Mayer, Ltd.

(57) ABSTRACT

A device for the generation of a shingled stream of flat, flexible objects along a conveyor path, wherein successive objects develop an overlap with a length, includes a first and a second suction and conveyor device having a first and second unit, respectively, and each having at least one conveyor belt. The first and second units are each configured to generate a vacuum through a whirlwind to attract at least one of the objects and are each disposed in a casing having a suction aperture. The second suction and conveyor device is disposed downstream from the first suction and conveyor device in a direction of the conveyor path with a mutual offset corresponding to the length of the overlap and is disposed at an angle relative to the direction of the conveyor path. The first and second suction are separated by a spacing in a transversal direction.

15 Claims, 12 Drawing Sheets

(56) References Cited

U.S. PATENT DOCUMENTS

| | | | | |
|---|---|---|---|---|
| 5,564,693 | A * | 10/1996 | Elkis et al. | 271/276 |
| 6,022,017 | A * | 2/2000 | Cummings et al. | 271/197 |
| 6,561,507 | B1 * | 5/2003 | Pollock | 271/182 |
| 7,014,187 | B2 * | 3/2006 | Mayerberg et al. | 271/197 |
| 7,296,792 | B2 * | 11/2007 | Kondratuk et al. | 271/197 |
| 7,628,396 | B2 | 12/2009 | Moore et al. | |
| 8,047,535 | B2 * | 11/2011 | Nishimura et al. | 271/197 |
| 8,550,460 | B2 * | 10/2013 | Berni | 271/277 |

FOREIGN PATENT DOCUMENTS

| | | | |
|---|---|---|---|
| DE | 199 45 114 | A1 | 3/2001 |
| DE | 10 2008 025 667 | A1 | 12/2009 |

* cited by examiner

METHOD AND DEVICE FOR THE GENERATION AND/OR CONVEYANCE OF A SHINGLED STREAM OF FLAT, FLEXIBLE OBJECTS

CROSS-REFERENCE TO PRIOR APPLICATION

Priority is claimed to German Patent Application No. DE 10 2012 207 285.3, filed on May 2, 2012, the entire disclosure of which is incorporated by reference herein.

FIELD

This invention relates to a method and a device for the generation and/or the conveyance of a shingled stream of flat, flexible objects—that may be used, for example, in cutting or printing operations.

BACKGROUND

In the course of cutting or printing operations, a continuous stream of flat, flexible objects is commonly conveyed to a collation area and, for example, further downstream to a tray from where they can be removed in batches. In the light of the relatively high conveyor speed of the cutting or printing equipment, the incoming stream of the individual objects must be slowed down significantly before these objects reach the tray in order to prevent them from being damaged in the transfer. The speed is commonly reduced by causing a partial overlap of the objects, which leads to the generation of a shingled stream. The generation of a shingled stream and, if needed, a growing overlap of the individual objects in the conveyance of the shingled stream reduces the speed of the individual objects at the end of the conveyor path. It is, for example, possible to reduce the speed by ratios of 5:1 to 8:1 even if the inflow velocity has exceeded 5 m/s, decreasing the kinetic energy of the objects for the transfer to the tray and therefore the force of the impact when entering the collation area.

Methods and devices for the generation and/or the conveyance of a shingled stream are known for example from DE 41 39 888 A1, DE 199 45 114 A1, U.S. Pat. No. 7,628,396 B2, DE 10 2008 025 667 A1 or DE 27 25 547 A1.

SUMMARY

In an embodiment, the present invention provides a device for the generation of a shingled stream of flat, flexible objects along a conveyor path, wherein successive objects develop an overlap with a length. A first suction and conveyor device includes a first unit and at least one conveyor belt. The first unit is configured to generate a vacuum through a whirlwind to attract at least one of the objects and is disposed in a casing having a suction aperture. A second suction and conveyor device is disposed downstream from the first suction and conveyor device in a direction of the conveyor path with a mutual offset corresponding to the length of the overlap. The second suction and conveyor device is disposed at an angle relative to the direction of the conveyor path. The second suction and conveyor device includes a second unit and at least one conveyor belt. The second unit is configured to generate a vacuum through a whirlwind to attract at least one of the objects and is disposed in a casing having a suction aperture. The first and second suction and conveyor devices are disposed on different sides of the conveyor path and separated by a spacing in a transversal direction of the conveyor path.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

Identical reference numbers identify identical or functionally identical components in all figures. For reasons of clarity and comprehensibility, not all reference numbers are provided in all figures.

DETAILED DESCRIPTION

Figure 1:
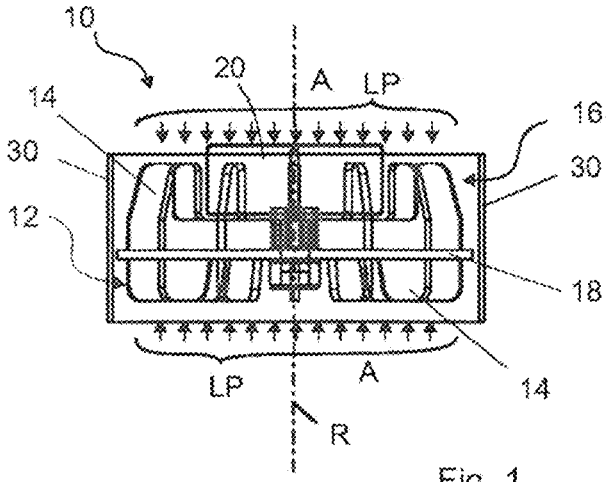
FIG. 1 Example for an embodiment of a vortex attractor (side view).

It has been recognized in the present invention that one negative consequence of conventional methods and devices for the generation and/or the conveyance of a shingled stream is the need for a vacuum generator in the form of a pump or a suction chamber. Together with the corresponding control valves and supply lines, this constitutes a significant cost factor in the overall system. Suction chambers are also problematic because they determine a certain spatial layout for successive objects, leaving little room for flexible arrangements, and because their apertures must be fully closed during operation because they could otherwise not properly fulfill their function of attracting the items through low pressure and of holding them tight, due to air bleed. Specific processes and techniques are required to prevent in particular the first and the last items of a batch from detaching themselves off the suction chamber. Due to the fixed spatial layout of the suction chambers, it is difficult to put any such device to flexible forms of use.

In an embodiment, the invention provides a method or a device for the generation and/or the conveyance of a shingled stream that allows more flexible usage and that ideally helps to reduce manufacturing or operating costs.

The device according to an embodiment of the invention to generate a shingled stream of flat, flexible objects alongside a conveyor path where successive objects create a partial overlap is characterized by the fact that the device features a first suction and conveyor mechanism with a first unit to generate a vacuum through a whirlwind for the attraction of at least one object, wherein the first unit has been accommodated inside a casing that features a suction aperture, and with at least one conveyor belt, the fact that the device features a second suction and conveyor mechanism with a second unit to generate a vacuum through a whirlwind for the attraction of at least one object, wherein the second unit has been accommodated inside a casing that features a suction aperture, and with at least one conveyor belt, the fact that the first suction and conveyor mechanism and the second suction and conveyor mechanism are located on different sides of the conveyor path, the fact that the first suction and conveyor mechanism and the second suction and conveyor mechanism have been arranged behind one another, offset by one length, in the direction of the conveyor path and that there is a spacing between them in transversal direction to the conveyor path, and by the fact that the second suction and conveyor mechanism (downstream in the direction of the conveyor path) is inclined against the direction of the conveyor path by an angle. Since the suction and transport devices—that are based on a whirlwind mechanism—do not require a specific spatial pitch dimension, the device according to an embodiment of the invention is open to more flexible forms of use. The use of two suction and conveyor devices permits—since the whirlwind-based suction and conveyor devices generate higher suction forces than conventional suction chambers—the provision of a spacing in transversal direction of the conveyor path, which in turn helps to protect the flat, flexible objects from being crumpled or bent. If two identical suction and conveyor devices are applied, they will apply substantially equivalent forces on the flat, flexible objects, ensuring that the slippage is equally distributed to the two suction and conveyor devices and that the flat, flexible objects are subjected to lower levels of stress. Suction and conveyor devices that are based on a whirlwind mechanism also generate higher suction forces than conventional suction chambers, attracting objects to the suction apertures across relatively greater distances.

A preferred embodiment is characterized by an offset between the two devices that exceeds the length of the first suction and conveyor device. The offset is defined as the distance between the rear edge of the first suction and conveyor device and the rear edge of the second suction and conveyor device, projected on to the conveyor path. If the offset is longer than the first suction and conveyor device, there will be a gap along the conveyor path between the first suction and conveyor device and the second suction and conveyor device. Due to the high suction forces generated by the whirlwind-based suction and conveyor devices, however, this is no problem for the transport of the flat, flexible objects, specifically allowing the generation and/or the conveyance of a shingled stream of flat, flexible objects with a smaller number of suction and conveyor devices than the number that would be required in the event that the offset were shorter than the first suction and conveyor device.

A particularly preferred embodiment is characterized by a spacing between the first suction and conveyor device and the second suction and conveyor device—transversally to the direction of the conveyor path—measuring between about 3 mm and 25 mm and ideally about 15 mm. This transversal spacing is defined as the shortest line between any point of the first suction and conveyor device and any point of the second suction and conveyor device. Such a spacing still allows the objects to be reliably attracted, due to the high holding forces that are generated by the suction and conveyor devices, while providing enough space for the flat, flexible objects to move around between the first suction and conveyor device and the second suction and conveyor device, if required, preventing them from being crumpled, bent or otherwise damaged.

Ideally, the angle between the two devices would range between 0° and 20° and would—in the most preferred embodiment—be about 10°. The incline of the second suction and conveyor device against the conveyor path lowers the rear edge of the object in relation to the object's front edge, helping in the generation of a shingled stream without damaging the objects.

In a preferred embodiment of the invention, the velocities of the conveyor belts in the different suction and conveyor devices can be individually controlled. This ensures that the overlaps are infinitely variable and allows the generation of a shingled stream with freely adjustable overlaps. Specifically since the suction and conveyor devices based on a whirlwind mechanism require no fixed spatial pitch dimension and since objects can therefore be in contact with any section of the conveyor belt, different lengths of overlap are possible and can be adjusted—on infinitely variable scales—during the operation of the device by varying the velocities of the conveyor belts.

A device according to an embodiment of the invention for the conveyance of a shingled stream of flat, flexible objects alongside a conveyor path, wherein successive objects create an overlap, is characterized by the fact that at least three suction and conveyor devices have been arranged alongside the conveyor path, wherein each of the suction and conveyor devices features a first unit to generate a vacuum through a whirlwind in order to attract at least one object, wherein the first unit has been accommodated within a casing that features a suction aperture, and wherein each of the suction and conveyor devices features at least one conveyor belt, wherein the suction and conveyor devices have been arranged behind one another in the direction of the conveyor path, and wherein the velocities of the conveyor belts for each of the suction and conveyor devices can be individually adjusted and controlled. The use of suction and conveyor devices that are based on a whirlwind mechanism allow the lengths of the overlap between the flat, flexible objects to be freely adjusted, particularly since the suction and conveyor devices have no fixed grid dimension for the contact of objects. Furthermore, the suction and conveyor devices allow objects to be attracted reliably across relatively large distances. Preferably, suction and conveyor devices will be arranged behind one another in the direction of the conveyor path with a spacing between them, wherein the spacing between successive suction and conveyor devices is defined as the spacing between the front edge of the first suction and conveyor device in the direction of the conveyor path and the rear edge of the subsequent (downstream) suction and conveyor device.

In a preferred embodiment of the invention, the suction and conveyor devices are arranged on the same side of the conveyor path and, ideally, above the conveyor path. By arranging the suction and conveyor devices above the conveyor path, the flat, flexible objects will be conveyed while being suspended, which means that the objects are pulled rather than pushed, reducing the risks of damaging the objects.

In a preferred embodiment of the invention, two successive suction and conveyor devices are positioned against each other against the plane of the objects in an angle that preferably measures between 0 and 60 degrees, and/or inclined on the level of the objects in an angle that preferably measures between 0 and 30 degrees. This allows the objects to change direction, making the device more flexible in use.

In a preferred embodiment of the invention, a device according to a embodiment of the invention that generates a shingled stream is combined with a device according to an embodiment of the invention that conveys a shingled stream, providing a device for the generation and conveyance of a shingle stream that is easy-to-assemble, cost-effective and highly flexible.

In a preferred embodiment of a device to generate a shingled stream, of a device to convey a shingled stream or of a device to generate and convey a shingled stream, at least one additional suction and conveyor device is provided in a transversal direction to the conveyor path next to each of the suction and conveyor devices. This will make it possible to handle even objects of particularly great width.

Preferably, the first and second units have impellers whose rotational speeds will ideally be individually adjustable for each of the suction and conveyor devices. Impellers are capable of generating a whirlwind in a simple and cost-effective fashion. If the rotational speeds can be individually adjusted for each suction and conveyor device (as in the preferred embodiment), it will also be possible to control the retention forces for each of the suction and conveyor devices individually and, ideally, on an infinitely variable scale, providing many different options of handling the objects and the shingled stream.

In a preferred embodiment, at least one, but ideally all, of the suction and conveyor devices will be equipped with at least two conveyor belts that, preferably, cover sections of the suction aperture. The use of two conveyor belts generally allows a tighter and more stable control of the objects.

In one preferred embodiment of the invention, at least one supporting element, ideally several supporting elements, is provided along the conveyor path, increasing the bending stiffness of the objects in the direction of the conveyor path.

According to another preferred embodiment of the invention, the uncovered length of an object is smaller than the length of one of the suction and conveyor devices and preferably exceeds 80% of the distance between the axles of the outer feed rollers of the conveyor belt in one of the suction and conveyor devices. The use of suction chambers requires that the uncovered length of an object, equivalent to the length of the object minus the length of the overlap, must not be smaller than the length of the suction and conveyor device. The use of whirlwind-based suction and conveyor devices makes it possible to ensure that objects are safely handed over from one suction and conveyor device to a downstream suction and conveyor device even if the uncovered length of an object is smaller than the length of one of the suction and conveyor devices.

The method according to an embodiment of the invention of generating and/or conveying a shingled stream of flat, flexible objects alongside a conveyor path, wherein successive objects create an overlap, is characterized by the fact that the length of the overlap within a shingled stream is infinitely variable. The option of adjusting the length of the overlap within the shingled stream on an infinitely variable scale makes the system highly flexible. It is specifically possible to vary the length of the overlap from one object to the next during the generation and/or the conveyance of the shingled stream by changing the module speed difference between two successive modules, without having to perform complex and time-consuming structural modifications of the device itself.

In a preferred embodiment of the method according to the invention, in a device to generate a shingled stream of flat, flexible objects alongside a conveyor path with a first suction and conveyor device that features a first unit to generate a vacuum through a whirlwind in order to attract at least one object, wherein the first unit is accommodated inside a casing that has a suction aperture, and featuring at least one conveyor belt, with a second suction and conveyor device that features a second unit to generate a vacuum through a whirlwind in order to attract at least one object, wherein the second unit in accommodated inside a casing that has a suction aperture, and featuring at least one conveyor belt, wherein the first suction and conveyor device and the second suction and conveyor device have been arranged on different sides of the conveyor path, wherein the first suction and conveyor device and the second suction and conveyor device have been offset against one another by one length in the direction of the conveyor path and where there is a spacing between them in transversal direction to the conveyor path, and wherein the latter (downstream) suction and conveyor device in the direction of the conveyor path has been inclined in an angle to the direction of the conveyor path, the velocities of the conveyor belts in the various suction and conveyor devices can be variably controlled during the operation of the system to adjust the lengths of the overlap. This ability to adjust the velocities of the conveyor belts in the various suction and conveyor devices individually and independently from one another on a variable scale during the operation of the system—i.e. above all the ability to change the speed levels of the conveyor belts on an infinitely variable scale at any time—ensures that the lengths of the overlap can be adjusted on an infinitely variable scale and that a shingled stream with freely adjustable lengths of overlap can be generated. Specifically since the suction and conveyor devices that are based on a whirlwind mechanism have no predetermined spatial pitch dimension and objects can have contact and be transported by any section of the conveyor belt, overlaps can be freely adjusted and varied during the operation of the system by changing the velocities of the conveyor belts on an infinitely variable scale.

In a preferred embodiment of a method according to the invention, a device to convey a shingled stream of flat, flexible objects alongside a conveyor path with at least two suction and conveyor devices that have been arranged along the conveyor path, wherein each of the suction and conveyor devices features a first unit to generate a vacuum through a whirlwind in order to attract at least one object, wherein the first unit has been accommodated inside a casing that features a suction aperture, and wherein each of the suction and conveyor devices features at least one conveyor belt, wherein the suction and conveyor devices have been arranged behind one another in the direction of the conveyor path, the speed levels of the conveyor belts in the various suction and conveyor devices can be variably controlled during the operation of the system to adjust the lengths of the overlap. This ability to adjust the speed levels of the conveyor belts in the various suction and conveyor devices individually and independently from one another on a variable scale during the operation of the system—i.e. above all the ability to change the speed levels of the conveyor belts on an infinitely variable scale at any time—ensures that the overlaps can be adjusted on an infinitely variable scale and that the lengths of the overlap in the previously generated shingled stream are freely adjustable on an infinitely variable scale. This means that a shingled stream can be built up during the operation of the system, for example in order to delay the discharge of the objects, and gradually dispersed by removing the objects individually.

FIG. 1 shows a vortex attractor 10 with a lower impeller 12 that is driven by a motor 20. The lower impeller 12 features a separator 18 and a large number of blades 14 that have been arranged radially—and in essence vertically—on the separator 18. The blades 14 and the separator 18 rotate around a rotational axis R. In one embodiment, a similarly designed upper impeller 16 with blades 14 is located on the opposite side of separator 18. In one embodiment, one of the two impellers 12, 16, preferably the upper impeller 16, is used to cool the motor 20. Separator 18 can be positioned symmetrically between the upper impeller 16 and the lower impeller 12, but in one embodiment, the upper impeller 16, used to cool the motor 20, is preferably of lower height than the lower impeller 12 which generates the vacuum to attract an object 40. In one embodiment, vortex attractor 10 features only the lower impeller 12 to generate a vacuum by means of a whirlwind (see FIG. 4).

Motor 20 can be embodied as a direct current or an alternative current motor. For example, motor 20 may be embodied as a brushless direct current motor or a stepper motor, for example with a rotational speed of app. 15,000 revs/minute to 25,000 revs/minute, preferably with a rotational speed of app. 20,000 revs/minute. With speeds such as these, using an impeller wheel diameter of app. 50 mm and a blade height of app. 8 mm, one could generate a vacuum retention force of app. 1.6 N to attract an object 40 from a distance of app. 4 mm.

The blades 14 can be embodied in a variety of shapes, for instance rounded like shovels. In one embodiment, however, the blades 14 are essentially straight and flat and arranged in a radial pattern. This allows the impellers 12, 16 to rotate either way.

In one embodiment, the upper impeller 16 and the lower impeller 12 are made from lightweight material such as plastic and have preferably diameters of app. 50 mm.

In another embodiment, which is represented in FIG. 1, the blades 14 of the upper impeller 16 can feature a recess in a lower, interior and radially extending section in which motor 20 may be accommodated. Alternatively, motor 20 can, of course, also be accommodated outside of the upper impeller 16.

Figure 3:
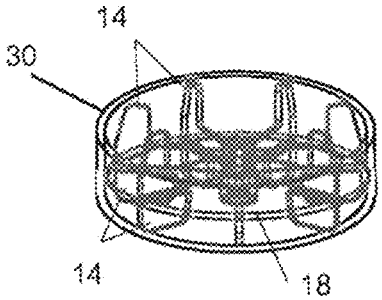
FIG. 3 Impeller of a vortex attractor (representation in perspective).

The vortex attractor 10 may feature a casing 30 that encloses the outer edges of separator 18, if such a separator has been provided, and the outer edges of the blades 14. The casing 30 can be designed in the shape of a bowl or a ring that is separated from the blades 14 (see FIG. 1) in order to provide a specifically lightweight impeller wheel. Alternatively, the impeller 12 and/or the impeller 16 may also be designed in such a way that a ring which forms the casing 30 is directly attached to the outer edges of the blades 14 or the outer edge of the separator 18 (see FIG. 3).

Figure 2:
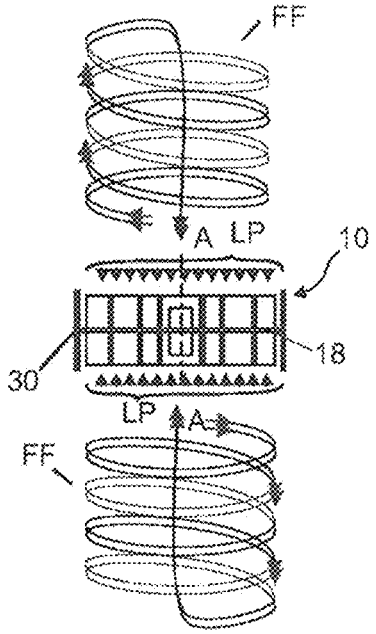
FIG. 2 The air flow generated by a vortex attractor according to FIG. 1.

The term vortex attractor 10 covers any device that generates a whirlwind FF. The (particularly) radially arranged blades 14 generate the air flow FF, which specifically resembles a whirlwind and in turn generates a vacuum region LP in front of the impeller 12 (see FIGS. 1 and 2). The air current FF features a rotational axis that is substantially identical with the rotational axis of the blades 14. The vacuum region LP generates a force of attraction A, which allows the vortex attractor 10 to attract an object 40 and/or to move towards the surface of an object, if the vortex attractor 10 is not in a fixed position. Vortex attractors 10 are specifically suitable for approaching even as well as uneven surfaces of objects 40 and to move such objects through space if required.

Figure 4:
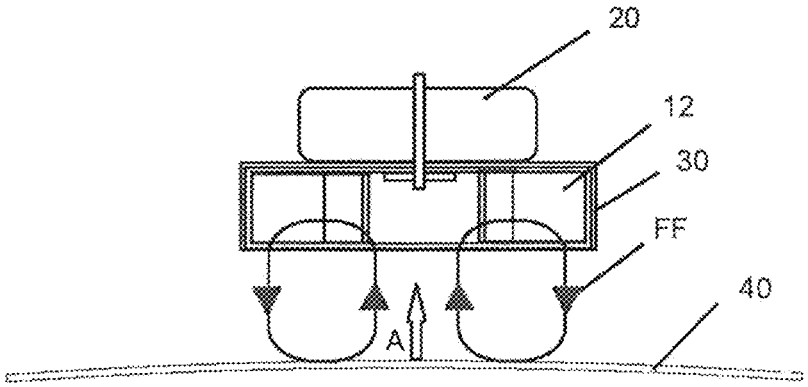
FIG. 4 Another example for an embodiment of a vortex attractor (schematic view).

FIGS. 5 to 10 present different views of a first example for an embodiment of a suction and conveyor device M, featuring a vortex attractor 10, for example a vortex attractor 10 according to FIG. 1 or 4, in a casing 30*a* that has been additionally equipped with two conveyor belts 34. The casing 30*a* features a suction aperture 33 (see FIG. 6), behind which the impeller 12 of the vortex attractor 10 is located. In order to protect the impeller 12 from possible damage through objects 40 and, vice versa, to protect the objects 40 from any potential damage that might be caused by the impeller 12, one embodiment of the invention features several bars 32 in front of the suction aperture 33 while an alternative embodiment features a protective grid.

The conveyor belts 34 are embodied as endless belts and routed around the casing 30*a*. For this purpose, two feed rollers 36 and two deflection pulleys 35 are provided in the casing 30*a* for each of the conveyor belts 34. The section of the conveyor belts 34 between the feed rollers 36 serves as the contact area for the conveyed objects 40. The maximum length over which the object 40 may abut the conveyor belt 34 is equivalent to the distance between the two axes TA of the feed rollers 36 (see FIG. 7). The deflection pulleys 35 route the conveyor belt 34 to the opposite side of the casing 30*a* (the side that lies opposite the suction aperture 33).

Figure 5:
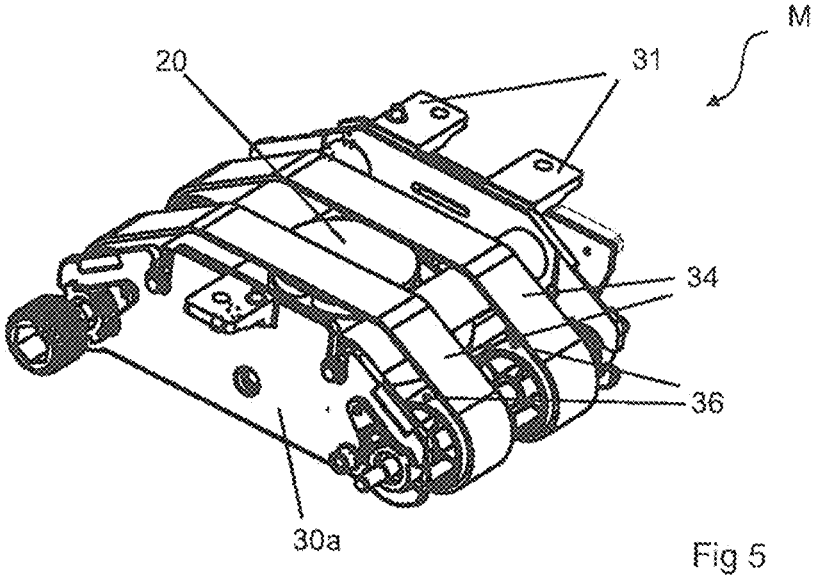
FIG. 5 Example for an embodiment of a suction and conveyor device that has been equipped with an external drive (representation in perspective).
Figure 6:
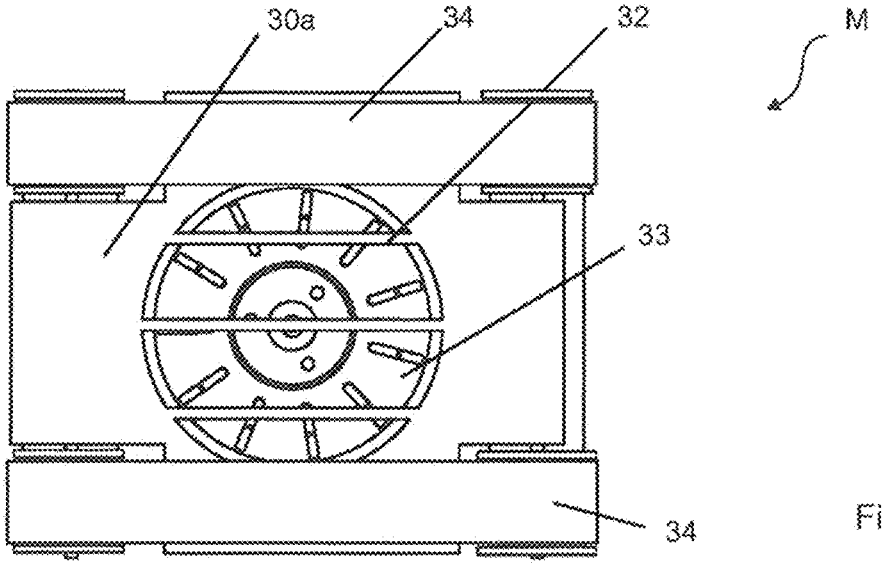
FIG. 6 Another example for an embodiment of a suction and conveyor device with its own drive (view from below).

It is in principle possible to use the feed rollers 36 and the deflection pulleys 35 to operate more than a single conveyor belt 34. The conveyor belts are routed around the casing 30*a* in such a way that they run substantially parallel to the wall of the casing 30*a* on the side into which the suction aperture 33 has been integrated, that they climb via the feed rollers 36 on the front sides of the casing 30*a* and that they are returned via the deflection pulleys 35 on the side wall of the casing 30*a* that lies opposite the suction aperture 33. The conveyor belts 34 can be powered by an external motor—via drive 37*a*—at one of the feed rollers 36, for example, as shown in the embodiment of FIG. 5. Such an external engine has the advantage that suction and conveyor devices in parallel operation can be powered by a frictional connection, a common axle for example, as explained subsequently in the notes for FIG. 24. Alternatively, each suction and conveyor device M can be equipped with its own belt motor 37 to power the conveyor belt 34 (see FIG. 7). The belt motor 37 can either be embodied as a step motor, a direct current motor or an induction motor. In one embodiment, a transmission 38 is installed in between the belt motor 37 and one of the feed rollers 36 (see FIG. 7).

The suction and conveyor device M may feature an individual controller 39 that preferably controls the motor 20 of the impeller 12 and, if provided, the belt motor 37 to power conveyor belt 34. Preferably, the motor 20 and the belt motor 37 are mutually independent, independent from other suction and conveyor devices and capable of being controlled individually during the operation of the system, preferably on separate, infinitely variable scales. The individual controller 39 can be selected via a flat-ribbon cable 39*a*.

Figure 7:
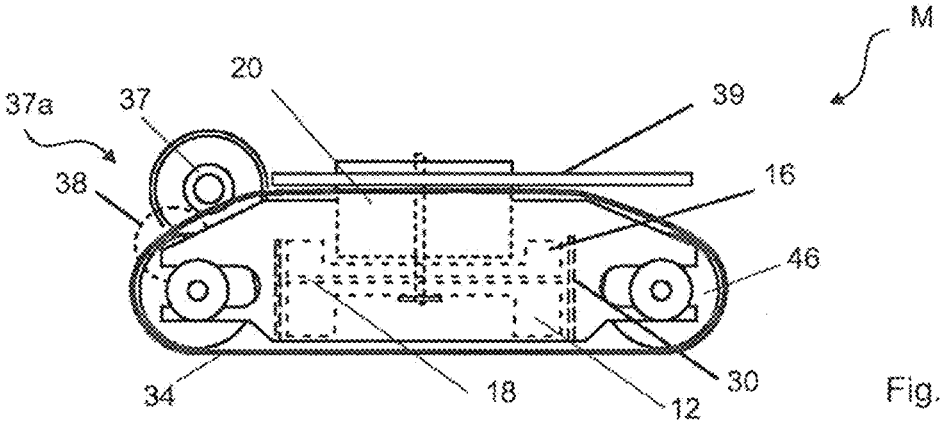
FIG. 7 Suction and conveyor device according to FIG. 6 (side view).
Figure 8:
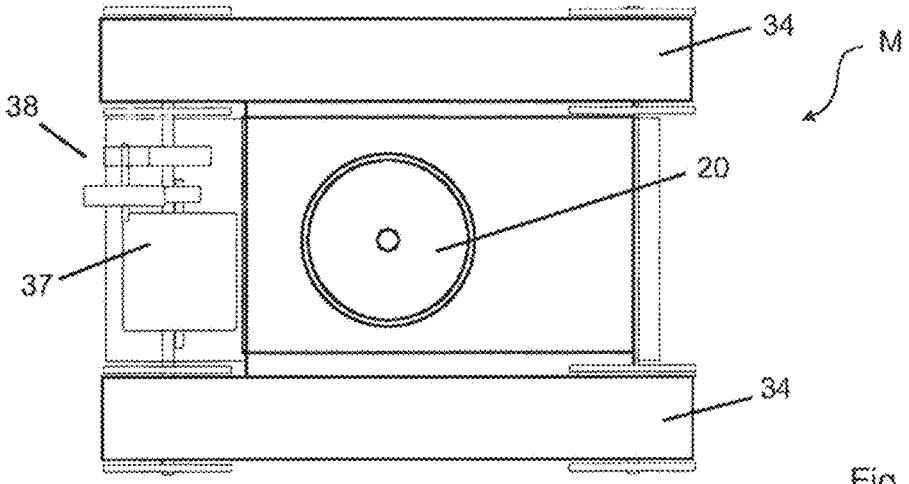
FIG. 8 Suction and conveyor device according to FIG. 6 (view from above).
Figure 9:
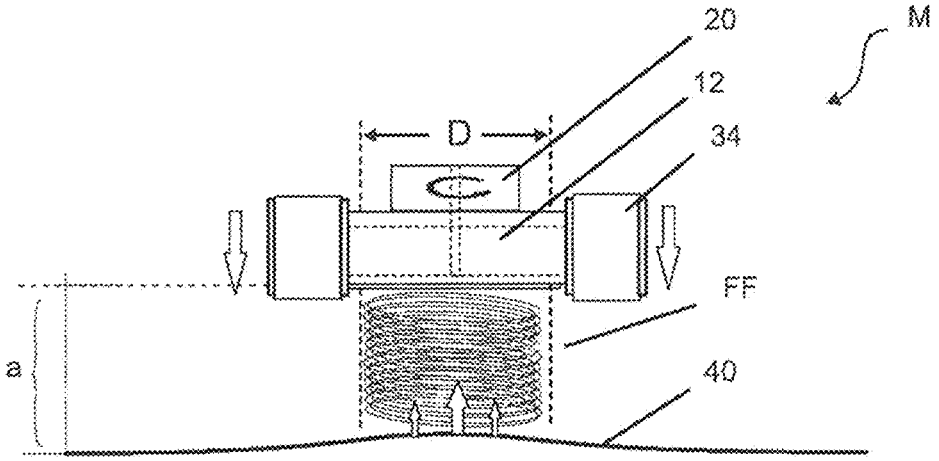
FIG. 9 The air flow generated by the suction and conveyor devices according to FIG. 6 to attract objects (schematic representation).
Figure 10:
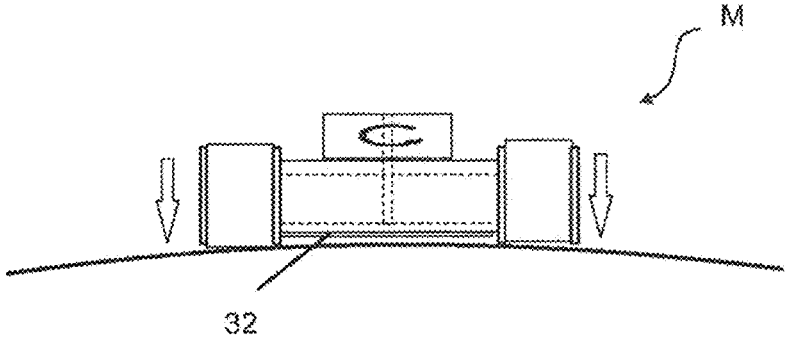
FIG. 10 Suction and conveyor device according to FIG. 9 with object that has been attracted.
Figure 11:
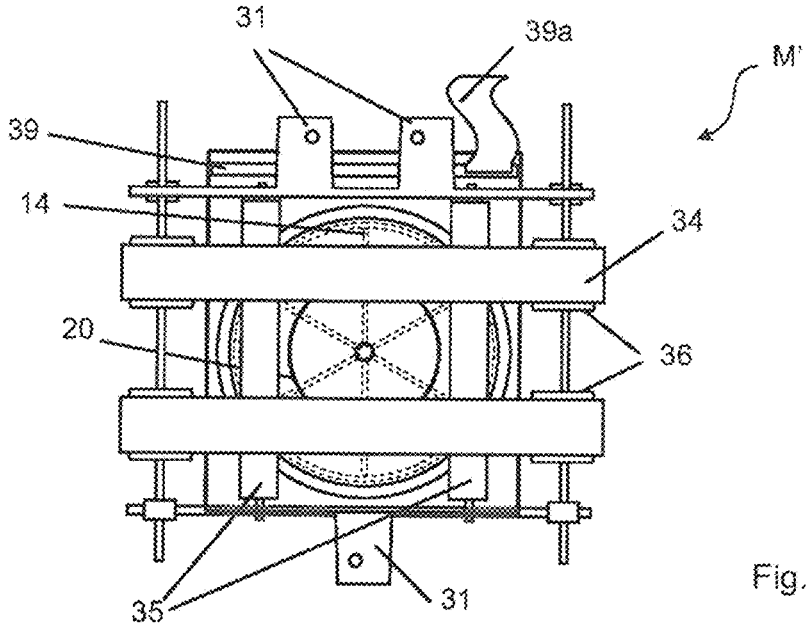
FIG. 11 Another example for an embodiment of a suction and conveyor device (view from above).
Figure 12:
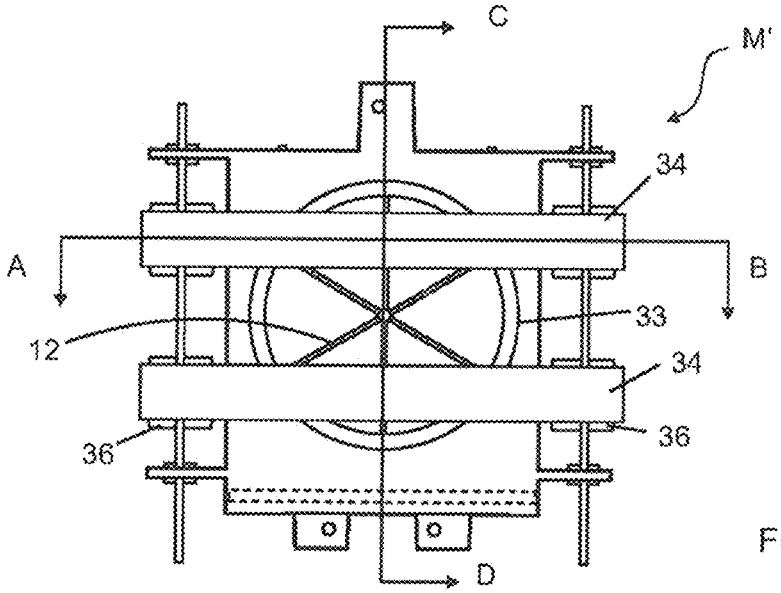
FIG. 12 Suction and conveyor device according to FIG. 11 (view from below).
Figure 13:
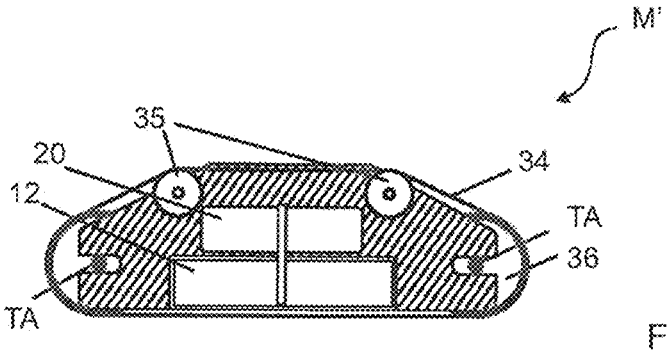
FIG. 13 Cross-section (along the line A-B) of the suction and conveyor device according to FIG. 12.
Figure 14:
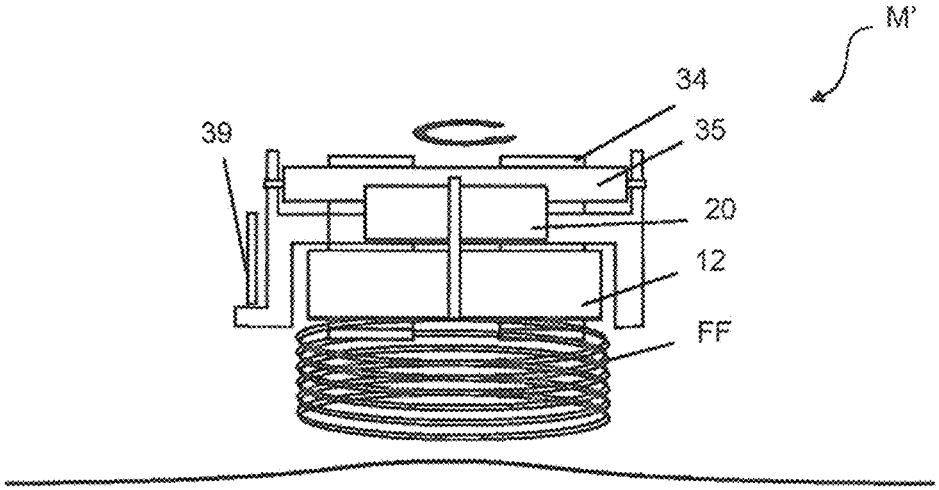
FIG. 14 Cross-section (along the line C-D) of the suction and conveyor device according to FIG. 12 and the air flow generated to attract objects (schematic view).
Figure 15:
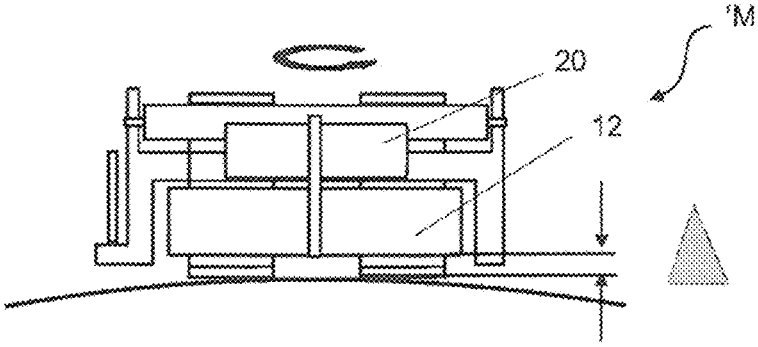
FIG. 15 Suction and conveyor device according to FIG. 14 with object that has been attracted.

FIG. 9 shows (in a schematic representation) how the air current FF is generated by the suction and conveyor device M according to FIG. 7 in order to attract an object 40—which has been positioned in a spacing "a"—on to the conveyor belts 34 as represented in FIG. 10. If the conveyor belts 34 are in operation, the object 40 will be conveyed by the conveyor belts 34.

Figure 16:
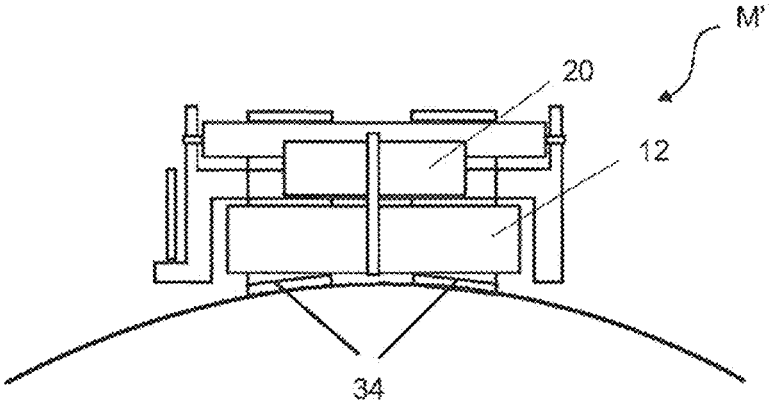
FIG. 16 Representation according to FIG. 14 with an object (attracted) showing the local deformations that have been caused by the arrangement of the belts.

FIGS. 11 to 16 show various views of another example for an embodiment of a suction and conveyor device M' that is distinguished from the suction and conveyor device M (represented in FIGS. 5 to 10) only inasmuch as the conveyor belts 34 have been positioned in a different way. Where the conveyor belts 34 of the suction and conveyor device M in FIGS. 5 to 10 fail to cover the suction aperture 33, the conveyor belts 34 of the suction and conveyor device M' according to FIGS. 11 to 16 are routed over the suction aperture 33. By routing the conveyor belts 34 over the suction aperture 33, the suction force is only slightly reduced, specifically if the conveyor belts 34 have a flat cross-section, for example a strength of 0.8 mm and a width of app. 15 mm, while the suction aperture 33 has a diameter of app. 50 mm. Despite the fact that the suction aperture 33 is partially covered, the whirlwind that is generated by the impeller 12 will also have an effect outside of the conveyor belt 34, ensuring that the suction force remains high. The advantage of positioning the conveyor belts 34 above the suction aperture 33 in this way is that there is no longer a need for bars 32 or a protective grid, since the conveyor belts 34 themselves prevent the object 40 from getting into any type of undesired contact with the blades 14 of the impeller 12. The arrangement of routing the conveyor belts 34 over the suction aperture 33 also ensures that object 40 undergoes the contortions that are shown in FIG. 16. Due to the curvature, the objects 40 are contorted on the vertical plane following which their widths are reduced transversally to the direction of the conveyor path TR, essentially making it possible to route the objects in a parallel operation and to discharge them without extending the conveyor path for the objects 40 of such a parallel operation. The reduction in width is caused by the geometrical arrangement of the conveyor belts 34 relative to the suction aperture 33. The reduction in width is dependent on the level of bending stiffness of object 40 and on the suction force generated by vortex attractor 10. A thin object with low levels of bending stiffness can be more easily bent, whereas an object with a high paper density and/or level of bending stiffness requires a higher suction force to develop the same degree of curvature. The development of such a curvature is helped by the elasticity of the conveyor belts 34 that adapt to the curvature of the object 40 in the area of the suction aperture 33, due to the suction force that is generated (see FIG. 16).

Figure 17:
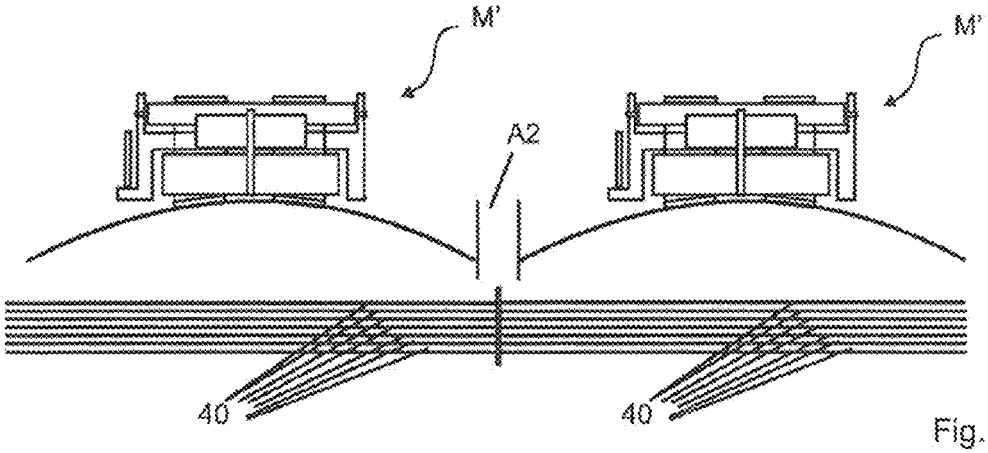
FIG. 17 Two suction and conveyor devices, in parallel arrangement and in transversal direction to the conveyor path according to FIG. 16, with objects that have been attracted.

FIG. 17 also shows the desired contortion of the objects 40. FIG. 17 shows two suction and conveyor devices M' that have been positioned side-by-side (i.e. transversally to the direction of the conveyor path), conveying the objects 40 in a direction that is vertical to the level of the paper. Underneath the suction and conveyor devices M', there is a stack of objects 40 that have been essentially arranged in a horizontal direction without contortions, ensuring that their spacing A1—that results from the cutting—is significantly smaller than the spacing A2—that results from the contortion—of the curved objects 40 which are suspended from the suction and conveyor devices M'.

Figure 18:
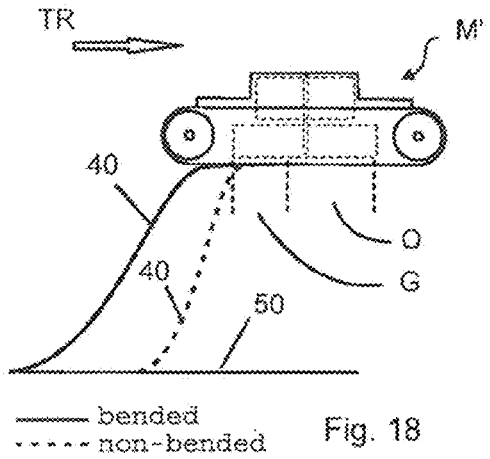
FIG. 18 Suction and conveyor device according to FIG. 12 with adjacent object that does not cover the entire suction aperture.
Figure 19:
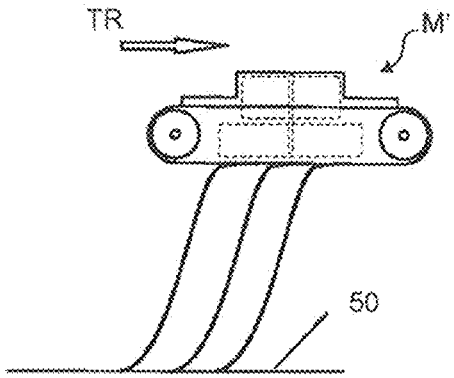
FIG. 19 Suction and conveyor device according to FIG. 12 with several objects that are retained by a suction aperture.

FIGS. 18 and 19 illustrate another advantage of the suction and conveyor devices M'. Experiments and measurements have shown that the suction aperture 33, specifically the projected surface of the impeller wheel, does not have to be covered entirely in order to generate a suction force in a distance of up to 40 mm from the suction aperture 33. If object 40 only covers 30% of the surface of the suction aperture 33, the suction force operating on object 40 still amounts to 1.2 N at a distance of app. 4 mm away from suction aperture 33. As shown in FIG. 18, an object 40 will still be reliably retained by the suction and conveyor device M' despite an open area O of the suction aperture 33 and an only partially covered area G of the suction aperture 33.

Figure 20:
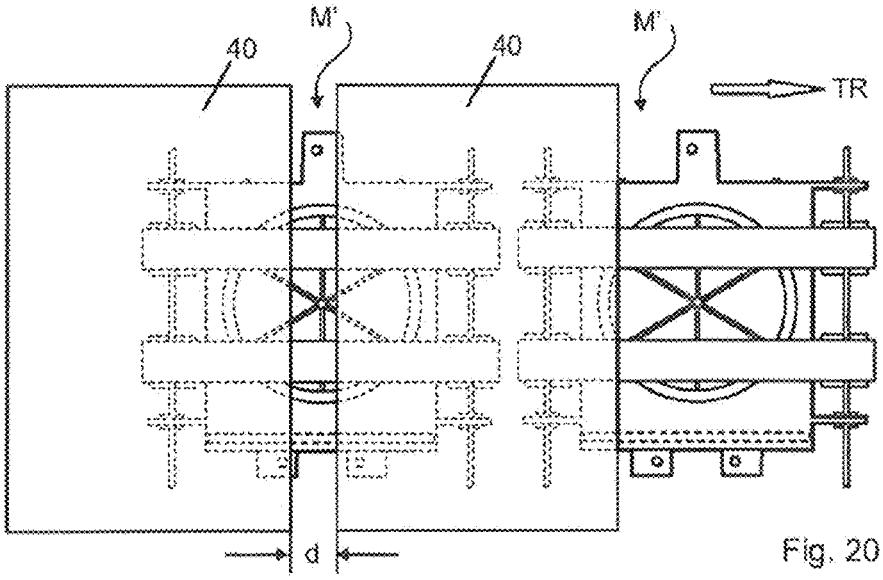
FIG. 20 Two suction and conveyor devices according to FIG. 12 that have been successively arranged alongside a conveyor path during the transfer of an object from one suction and conveyor device to the downstream suction and conveyor device.

It is furthermore possible to convey several objects 40 in the direction TR behind one another at the suction aperture 33 in a single suction and conveyor device M'. It is therefore also possible, for example, to convey up to three objects of an A4 format and a paper density of up to 80 g/sqm that are suspended from a single suction and conveyor device M'. Provided the level of bending stiffness of the object 40 and the degree of contortion that has been achieved through the suction and conveyor device M' are sufficiently high, this object can also—due to its dimensional stability—be transferred in suspension to the following suction and conveyor device M' (see FIG. 20). Due to the suction force that is still in effect in a distance of up to 50 mm away from the suction aperture 33, the object 40 is affected by the vacuum generated through the downstream suction and conveyor device M and pulled against the conveyor belts 34 of the downstream suction and conveyor device in the direction of the suction aperture 33. It is also possible to maintain a distance d between the objects 40 in the direction of the conveyor path TR as represented in FIG. 20. The suction and conveyor devices M, M' therefore make it possible to retain and to convey objects 40, even when the suction aperture 33 is only partially covered.

FIGS. 18 and 19 show additional supporting elements 50 that may help to increase the levels of bending stiffness of objects 40 that are conveyed along the conveyor path. FIG. 18 shows how supporting element 50, possibly embodied as a steel rope, increases the bending stiffness of object 40 in such a way that the area of contact with the conveyor belt 34 is increased.

Figure 21:
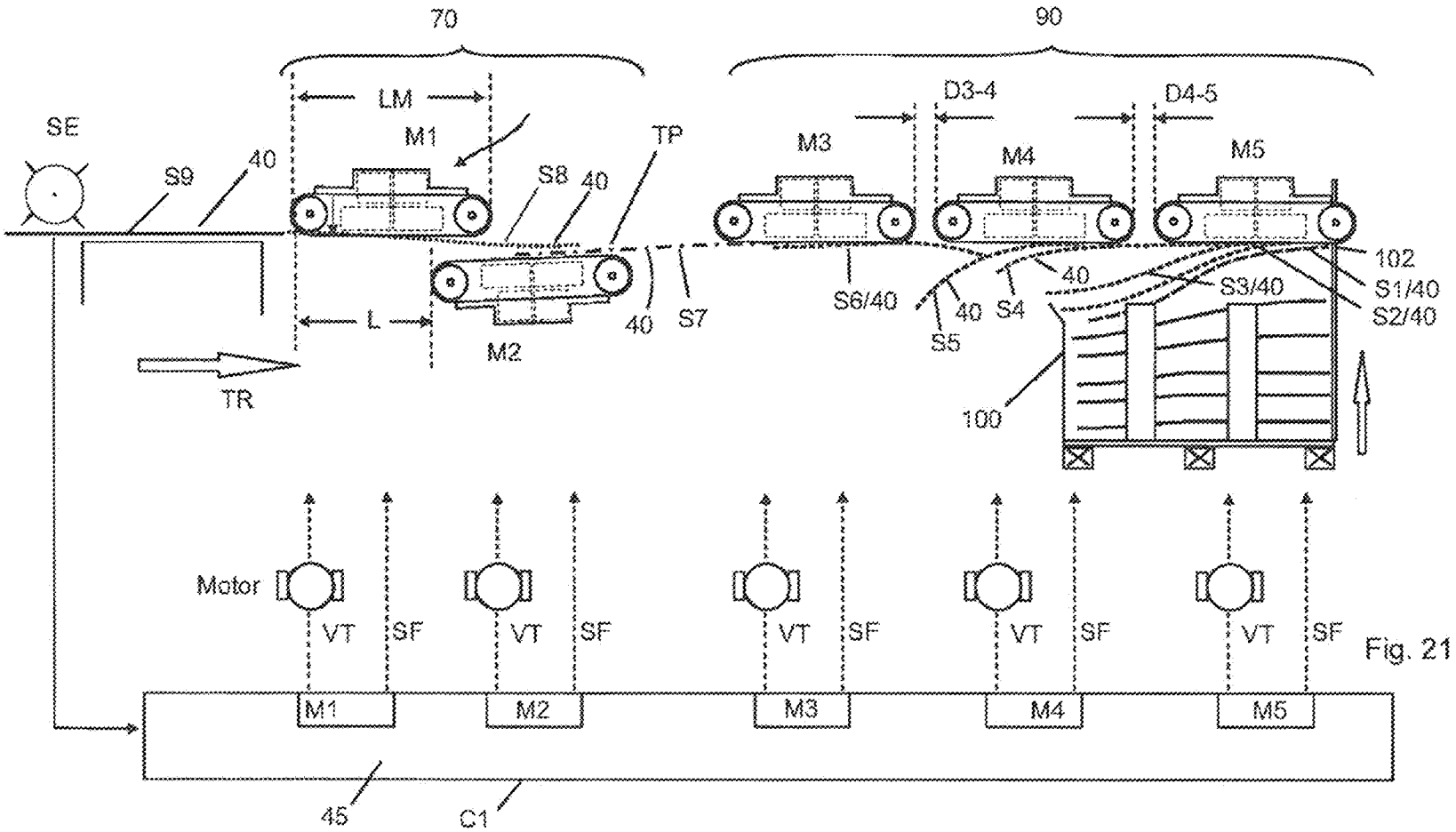
FIG. 21 Device to generate a shingled stream and device to convey a shingled stream (schematic view).

FIG. 21 shows a device 60 to generate and to convey a shingled stream of objects 40 that features a device 70 to generate the shingled stream of objects 40 and a device 90 to convey the shingled stream of objects 40. It must be noted that the device 70 to generate the shingled stream of objects 40 does not necessarily have to be combined with the device 90 to convey the shingled stream of objects 40: instead, both devices 70, 90 are independent from one another. The devices 70, 90 can be arranged with a spacing D2-3 in the direction of the conveyor path TR.

The device 70 to generate the shingled stream of flat, flexible objects 40 such as, for example, cut objects 40 like paper sheets or similar objects features a first suction and conveyor device M1 and a second suction and conveyor device M2. The suction and conveyor devices M1, M2 can, for example, be embodied like the suction and conveyor device M, described in FIGS. 5 to 10, or like suction and conveyor device M', described in FIGS. 11 to 16. Preferably, the suction and conveyor devices M1, M2 are embodied in identical models.

The objects 40, located within the device 60 in the positions marked S1, S2, S3, S4, S5, S6, S7, S8, and S9, are conveyed alongside a conveyor path TP in the direction TR. The objects 40 that have been separated and cut by a cutting device SE—specifically a vertically and horizontally operating cutting device—are individually and successively, without any overlap, fed into the device 70 to generate the shingled stream of objects 40 (see Position S9). The objects 40 are conveyed with an inflow velocity Ve. The first suction and conveyor device M1 and the second suction and conveyor device M2 are arrayed on opposite sides of the conveyor path TP. In particular, the first suction and conveyor device M1, located upstream in the direction of the conveyor path TR before the second suction and conveyor device M2, is located above the conveyor path TP, while the second suction and conveyor device M2 is located underneath the conveyor path TP. The suction and conveyor devices M1, M2 have a length LM. The suction and conveyor devices M1, M2 have been offset against one another by a length L in the direction of the conveyor path TP, a length which is embodied for the purposes of the represented example as a length that is smaller than the length LM of one of the suction and conveyor devices M1, M2, but which can also be greater than the length LM of one of the suction and conveyor devices in an alternative embodiment, for example 25% longer than the length LM of one of the suction and conveyor devices M1, M2. FIG. 22*e* shows a detailed representation of such an embodiment. The length L is preferably determined in such a way that the whirlwinds and air currents generated by the suction and conveyor devices M1, M2 do not interfere with one another and ideally pass each other in a distance SW, preferably measuring between app. 5 and 10 mm (see FIG. 22*e*).

FIGS. 21 and 22*e* show that the two suction and conveyor devices M1, M2 are arranged opposite each other in a spacing AM transversally to the conveyor path TP, being positioned on opposite side of the object 40, but not simultaneously abutting opposite sides of the object 40. The spacing AM measures 3 to 25 mm, preferably between 10 and 15 mm.

The second suction and conveyor device M2 is furthermore arranged in an angle a against the direction of conveyance TR or the conveyor path TP, again illustrated by FIGS. 21 and 22*e*. The angle a falls into a range between 0 to 20 degrees and preferably measures about 10 degrees.

The movement of object 40 between the two suction and conveyor devices M1, M2 is explained in closer detail by FIGS. 22*a* to 22*d*. The object 40 is being fed to the device 70 to generate the shingled stream of objects 40 (see FIG. 22*a*). The distance D1 between consecutive objects 40 can range between 2 mm and 30 mm, for example app. 20 mm.

Figure 22A:
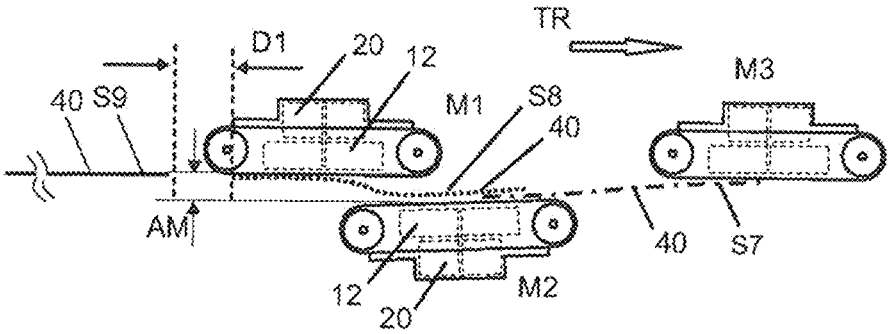
FIG. 22*a* Snapshot of the movement of objects in a device to generate a shingled stream according to FIG. 21.
Figure 22B:
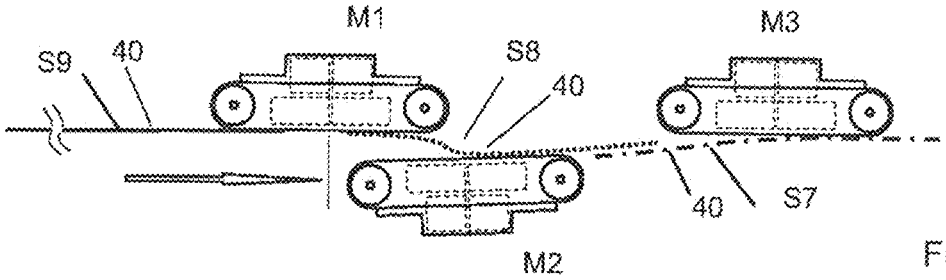
FIG. 22*b* Snapshot of the movement of objects in a device to generate a shingled stream according to FIG. 21.

Due to the spacing AM—transversally to the conveyor path TP in vertical direction—between the first suction and conveyor device M1 and the second suction and conveyor device M2, the leading edge of the object 40 will be hanging down after a certain length of the object 40 has passed the suction aperture 33 of the first suction and conveyor device M1 (see FIG. 22*a*). The leading edge will be placed on the conveyor belts 34 of the second suction and conveyor device M2. The conveyor belts of the suction and conveyor devices M1, M2 are essentially moving at identical velocities.

Figure 22C:
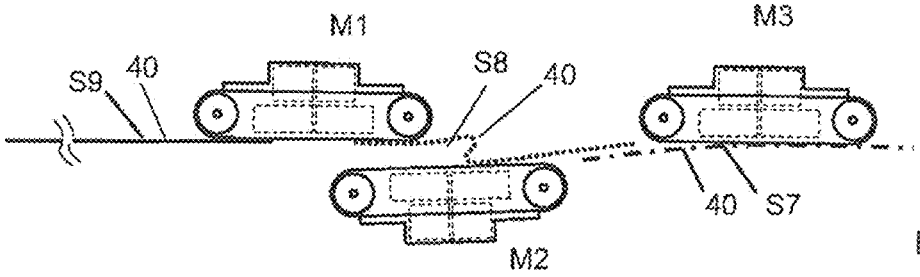
FIG. 22*c* Snapshot of the movement of objects in a device to generate a shingled stream according to FIG. 21.

As soon as the trailing edge of the object 40 in position S9 has reached the mid-way point of the suction aperture 33 in the first suction and conveyor device M1 (see FIG. 22*b*), the velocity of the conveyor belts 34 in the second suction and conveyor device M2 will be reduced—depending on the objects 40 that are about to be conveyed—to app. 10% to 90% of the inflow velocity Ve. Since the conveyor belts 34 of the first suction and conveyor device M1 continue to operate under their original velocity, the object 40 in position S8 will be pushed on top of the preceding object 40 in position S7, creating an overlap and increasing any pre-existing overlap. The handling of objects 40 with relatively high levels of bending stiffness can generate occurrences of slippage, since the part of object 40 that is being conveyed at the relatively higher speed and that abuts the first suction and conveyor device M1 will be slowed down by the part that is conveyed at the relatively lower speed and that abuts the second suction and conveyor device M2. Thin objects 40 that have a generally lower level of bending stiffness may form loops as represented in FIG. 22*c*. Due to the spacing AM between the first and the second suction and conveyor device M1, M2, such a loop will not necessarily damage the object 40. As soon as the trailing edge of the object 40 has reached roughly the mid-way point of the suction aperture 33 in the second suction and conveyor device M2 (see FIG. 22*d*), the velocity of the conveyor belt in the second suction and conveyor device M2 will be increased to its original level, i.e. to the level of inflow velocity Ve, straightening out any loops of the object 40 that may have formed. Following this, the object 40 will be transferred by the second suction and conveyor device M2 to a downstream processing device, for example—as will be described underneath—to the device 90 for the conveyance of the shingled stream of objects 40. FIG. 23 shows two successive objects 40 with an overlap Ü while they are being conveyed via the second suction and conveyor module M2. The shingled stream that has been generated by the device 70 is therefore still moving forward at the inflow velocity Ve when the objects are transferred to the downstream device.

Figure 22D:
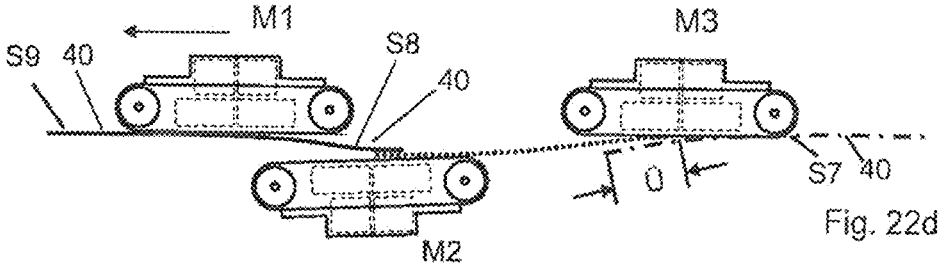
FIG. 22*d* Snapshot of the movement of objects in a device to generate a shingled stream according to FIG. 21.
Figure 22E:
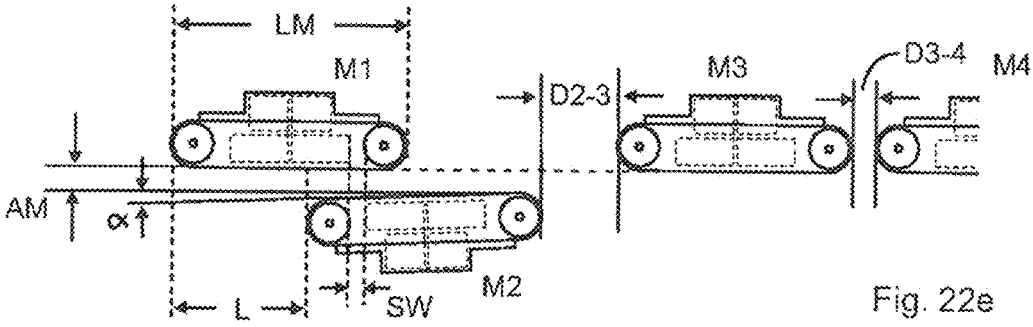
FIG. 22*e* Detail from FIG. 21.
Figure 23:
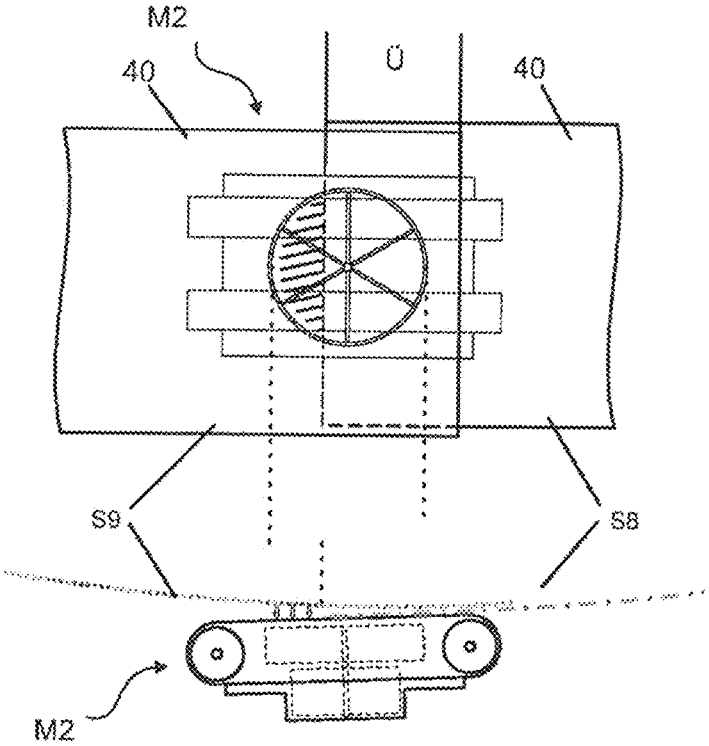
FIG. 23 The second suction and conveyor device of the device to generate a shingled stream according to FIG. 21, once in a view from above and once in a side view with two successive objects creating an overlap.

The device 70 therefore generates a shingled stream of objects 40 with an overlap that has a length of Ü, defined as the area between two successive objects 40 in which these two successive objects 40 overlap (see FIG. 22*d*).

The length of the overlap Ü can be adjusted on an infinitely variable scale with the aforementioned device 70 to generate the shingled stream, in dependence on the velocities of the conveyor belts 34 in the suction and conveyor devices M1, M2 and specifically the difference of the conveyance velocities of the suction and conveyor devices M1, M2 during the transfer of the object 40 from the first suction and conveyor device M1 to the second suction and conveyor device M2 (see FIGS. 22*a*-*d*).

By selecting the corresponding velocities of the conveyor belts, specifically in the second suction and conveyor device M2, it is possible to change the length of the overlap Ü at any moment, so that the length of the overlap Ü can be adjusted on an infinitely variable scale during the generation of the shingled stream to vary between individual successive pairs of objects.

The non-overlapping part of two successive objects 40 can be shorter than the length LM of one of the suction and conveyor devices M1 to M5 and even smaller than the diameter of the suction aperture 33 in one of the suction and conveyor devices M1 to M5.

The selection of the first and second suction and conveyor devices M1, M2 is performed through the control unit 45 that is preferably clocked by the cutting cycle of the cutting device SE. The times at which the conveyance speed of the second suction and conveyor device M2 needs to be changed is calculated on the basis of the length and the level of bending stiffness of the objects 40 as well as on the distances between them, following which the results of these calculations are converted into a numerical table. For objects 40 with either very high or very low levels of bending stiffness, the suction forces of the first and/or second suction and conveyor device M1, M2 can be adjusted, helping to control slippage and to prevent overly large loops. The control unit 45 can determine the velocities of the conveyor belts 34 in the individual suction and conveyor devices M1, M2 as well as the speeds of the impellers 12 in the vortex attractors 10 of the suction and conveyor devices M1, M2 independently from one another and while the system is in operation.

The device 90 to convey the shingled stream of objects 40 has, on the one hand, the purpose of conveying the shingled stream to a tray 100. On the other hand, the device 90 can serve to reduce the velocity of the objects 40 in order to prevent the objects 40 from being damaged when they are being discharged.

The device 90 features at least three suction and conveyor devices M3, M4, M5 that have been arranged successively along the conveyor path TP, preferably on one side of the conveyor path TP and above the conveyor path TP. In the direction of the conveyor path TP, a spacing D3-4 has been inserted between the suction and conveyor devices M3, M4 and a spacing D4-5 has been inserted between the suction and conveyor devices M4, M5. No direct contact with suction and conveyor devices M3, M4, M5 is required, due to the whirlwind-based principle of attraction. The spacings D3-4 and D4-5 can serve to increase the conveyance route or to reduce the number of suction and conveyor devices M3, M4, M5 that is required for any given conveyance route.

The velocities of the conveyor belts 34 in the suction and conveyor devices M3, M4, M5 and the rotational speeds of the impellers 12 in the vortex attractors 10 of the suction and conveyor devices M3, M4, M5 can also be adjusted independently from one another and individually controlled by the control unit 45 while the system is in operation.

During the transfer of the object 40 from the device 70 (that generates the shingled stream of objects 40) to the device 90 (that conveys the shingled stream of objects 40), the conveyor belts 34 of the upstream (in the direction of the conveyor path) and first suction and conveyor device M3 in device 90 can assume the same velocity as the conveyor belts 34 of the second suction and conveyor device M2 in device 70 (that generates the shingled stream of objects 40). The object 40 is conveyed from the suction and conveyor device M3 via position S7 and position S6 to position S5 in the direction of the downstream suction and conveyor device M4. The conveyor belts 34 of the suction and conveyor device M4 preferably operate at a lower speed than the conveyor belts 34 of the upstream suction and conveyor device M3. The object 40 is transferred from position S5 via position S4 into position S3 at the downstream suction and conveyor device M5. The conveyor belts 34 of the suction and conveyor device M5 preferably operate at a lower speed than the conveyor belts of the suction and conveyor device M4. If additional suction and conveyor devices have been arranged in successive order, the conveyor velocities of the conveyor belts 34 are preferably decreasing, so that a desired reduced exit velocity will be reached at the final suction and conveyor device. The inflow velocity can, for example, be as high as 6 m/s and 8 m/s for objects 40 with relatively high levels of bending stiffness. The exit velocity will preferably be no higher than 1 m/s. Once the object 40 has arrived at the final suction and conveyor device M5, the leading edge of the object 40 will strike an edge of the stack 102 and be pushed by successive objects 40 that are conveyed further in the direction TR of the conveyor path by the conveyor belts 34 of the suction and conveyor device M5. First the overlap with the following object 40 will increase, and finally the preceding object 40 will be peeled off by the conveyor belts 34 of the suction and conveyor device M5 (see the two objects 40 in positions S2 and S1) before falling into the tray 100.

By selecting and changing the velocities of the conveyor belts 34 in the suction and conveyor devices M3, M4, M5, the overlap in the shingled stream of objects 40 can be controlled and adjusted on an infinite scale across the length of the device 90. If required, the shingled stream can also be temporarily accumulated, generating a long overlap that may then be decreased during the ensuing conveying action. This may be beneficial, for example, if such a high number of objects 40 have accumulated in the tray 100 that this tray 100 must be discharged or exchanged for an empty tray 100. Once the tray 100 has been discharged or exchanged, the piled-up shingled stream of objects 40 can be reduced by selecting the corresponding velocities of the downstream suction and conveyor devices, discharging the objects 40 into the new tray 100 or the newly emptied tray 100.

In order to determine the final velocity, the final suction and conveyor devices, in this embodiment the suction and conveyor devices M4, M5, are of specific relevance. An inflow velocity of 5 m/s, for example, can be reduced to an exit velocity of 1 m/s. The required final velocity is defined as the maximum velocity under which the objects 40 do not suffer any damage from a collision with the edge of the stack 102 and under which they are neither thrown back as a consequence of the elasticity of the objects 40 nor come to lie disorderly in the tray 100. For most objects 40, this is equivalent to a velocity of about 1 m/s, but this value is dependent on the qualities of the objects 40 and may, if required, need to be reduced further. The conveyor belts 34 of the final suction and conveyor device M5, at which the objects are peeled off into the tray 100, are operated with the required final velocity. This velocity of the suction and conveyor device M5 may be 1 m/s, while the preceding suction and conveyor device M4 is still operated with a velocity of 2.5 m/s. It is of course possible to reduce the final velocity through a higher number of suction and conveyor devices, specifically if thin objects 40 with low levels of bending stiffness require a lower original velocity of significantly under 1 m/s, for example 0.8 m/s. Alternatively, additional suction and conveyor devices may also serve to increase the inflow velocity at an identical final velocity of about 1 m/s. The greater the difference between inflow velocity and exit velocity, the higher—as a rule of thumb—the number of suction and conveyor devices that are required to gradually reduce the velocity.

The velocities of each suction and conveyor device (M1 through to M5) can be controlled via the control unit 45, ensuring the high level of flexibility of the device 60.

It is additionally possible to control the speeds of the impellers 12 in the vortex attractors 10 of the individual suction and conveyor devices M1 to M5 via the control unit, varying the levels of suction force. While a mean suction force of app. 0.8 N in a distance of 4 mm is enough for most objects 40, heavy objects 40 with paper density levels of up to 200 g/m$^2$ may require a suction force of 1.2 N per suction and conveyor device M1 to M5.

Alternatively, it could be useful to reduce the suction forces of suction and conveyor devices M1 to M5 individually (independently from one another). In thin objects 40 with lower levels of bending stiffness, for example, strong contortions of the object 40 at the suction aperture 33 in the suction and conveyor devices M1 to M5 can adversely affect the conveying operation, which is why the suction force can be adjusted to the object 40 by reducing the rotational speed of the motor 20 of vortex attractors 10. Normally, all suction and conveyor devices (M1 through to M5) would be operating with similar levels of suction force. If required, however, the suction forces of the individual suction and conveyor devices M1 to M5 can be separately controlled, for example to perform a friction adjustment. This may be specifically relevant for the first suction and conveyor device M1, in which a relatively low level of suction force may be required when the object 40 is accelerated during the transfer from the device 70 (that generates the shingled stream) to the device 90 (that conveys the shingled stream) to the point where its maximum velocity temporarily exceeds the inflow velocity Ve.

The device 60 with the suction and conveyor devices M1 to M5 largely covers the common sizes of objects 40 in the paper-processing industry. For example, the aforementioned device 60 featuring a total of five successively arranged suction and conveyor devices M1 to M5 can convey objects in dimensions (length×width) between 80 mm×110 mm and 530 mm×210 mm and levels of paper density between 40 g/m$^2$ and 250 g/m$^2$. The distances between the individual suction and conveyor devices M1 to M5 do not have to be changed. The minimum length of the objects 40 only depends on the size of the suction and conveyor devices M1 to M5. At a length LM of the suction and conveyor devices M1 to M5 of up to 110 mm, the shortest object 40 that can still be conveyed from one suction and conveyor device to the next suction and conveyor device is app. 80 mm long. Of course, shorter suction and conveyor devices M1 to M5 can also convey smaller objects 40 such as credit cards or objects 40 that are about as large as a postage stamp.

Figure 24:
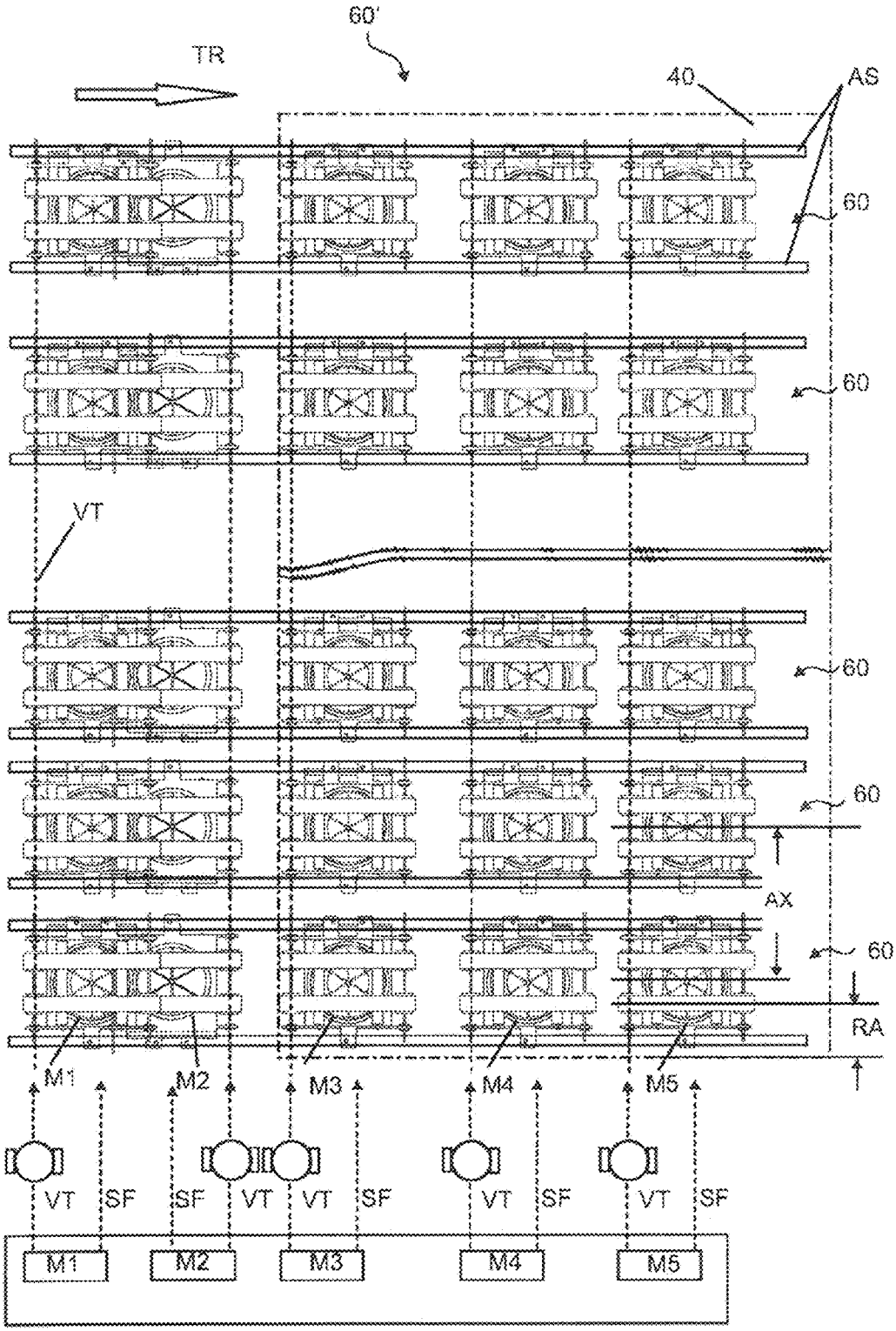
FIG. 24 Device to generate and convey a shingled stream according to FIG. 21 with several suction and conveyor devices that have been arranged next to one another.

In order to generate a shingled stream of oversized objects 40, for example objects in dimensions of 710 mm×530 mm and a paper density of up to 500 g/m$^2$, it is preferable to use several devices 60 in parallel operation in order to achieve the required (reduced) final velocity for the objects with their unusual weights and surface sizes. One example for such a device 60' is represented in FIG. 24. The individual devices 60 can be mounted on parallel support rails AS in order to vary the spacings AX. The spacings AX can be adjusted either manually or automatically (e.g. by electromechanical means such as motor or actuator). Depending on the size of the object 40, two such devices 60 may be enough to do the job. FIG. 24 shows a large number of devices 60 in a parallel arrangement. The devices 60 can be evenly distributed across the width of the object 40. When distributing the devices 60 across the width of the sheet, however, special attention must be dedicated to the distance from the margin. The smaller this distance of the suction area to the object's margin RA, the easier it will be to control the object 40, specifically at velocities in excess of 4 m/s. It should therefore be ensured that the distance to the margin RA is smaller than 25 mm. This is specifically important for the area of the overlap where the leading edge of the object 40 in position S8 may be colliding with the upright trailing edge of the object 40 in position S7 instead of overlapping and coming to a rest on the end of the sheet of object 40 in position S7.

The belts of the suction and conveyor devices M1 to M5 in the devices 60 that are arranged next to each other according to device 60' can either be powered individually by separate belt motors 37 of the conveyor belts 34, for each module M1 through to M5 of the device 60, or—preferably—be driven with the help of continuous axles VT that are powered by a single engine each.

The device 60' also makes it possible to discharge several objects 40 of a similar type that arrive on parallel tracks simultaneously into corresponding trays 100 via the individual devices 60. It is the change in the shape of the objects 40 under the suction force, i.e. the reduction of their width, which can be used to improve conveyance and discharge to proceed in parallel operation (see FIG. 17).

Based on the retention force of app. 1.2 N that is generated by a suction and conveyor device M1 to M5, one may conclude in principle that a single device 60 will suffice to convey and delay an object 40 of size A3 and a paper density of 200 g/m$^2$ which is inserted, transversally to the conveyor direction TR, into the device 90, since the normal weight of the object 40 will not exceed app. 0.25 N. It must be taken into account, however, that the object 40 will be subject to significant powers of air resistance when conveyed at velocities of 5 m/s to 8 m/s, specifically since the object 40 is not fastened at the edges and will most likely start to flutter. With this format and at the aforementioned inflow velocity, the use of a second device 60 is indeed almost mandatory, wherein any specific allocation of the two devices 60 should give priority to ensuring that the margins of the object 40 are covered rather than that the devices 60 are evenly distributed across the width of the objects 40.

The acceleration curves and times that are required for operational purposes as well as the control data for any objects 40 are established on the basis of the known parameters such as paper density and size, entered via a central control unit and programmed as control data. Depending on the exact type of object 40, the individual functions of any of the suction and conveyor devices M1 to M5 can be controlled by the control unit 45 in the device 60 to generate and convey the shingled stream of objects 40.

The aforementioned devices 70 to generate a shingled stream and devices 90 to convey a shingled stream can be used to convey flat, flexible objects 40 of different dimensions and materials including, for example, sheet metal, textiles, plastics and paper. Depending on the size of the objects 40, the dimensions of the individual suction and conveyor devices M1 to M5 and the required numbers of devices 60, 70 and 90 to constitute a device 60' will need to be adjusted accordingly.

Figure 25A:
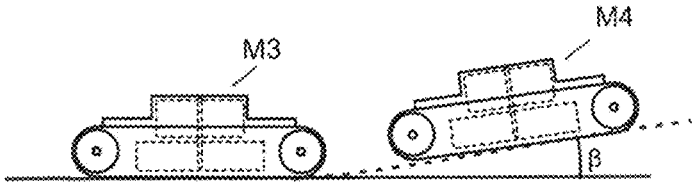
FIG. 25*a* Two successive suction and conveyor devices that have been arranged in an incline against one another and the plane of the objects (schematic view).
Figure 25B:
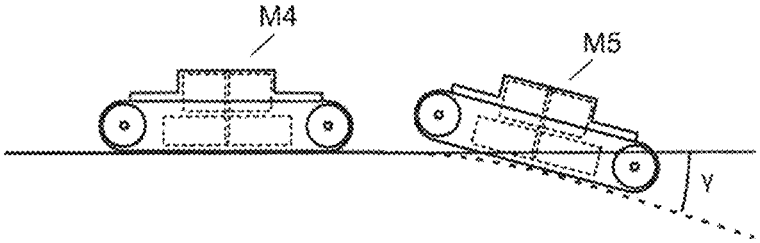
FIG. 25*b* Two successive suction and conveyor devices that have been arranged in an incline against one another and the plane of the objects (schematic view).

In order to provide the objects 40 with even more room to move around freely, it is possible to arrange two successive suction and conveyor devices M3, M4, M5 opposite each other in an angle β, γ, preferably in a range between 0° and 60°, against the plane of the objects 40, as shown for example in FIGS. 25*a* and 25*b*. In FIG. 25*a*, the objects 40 can be deflected upwards from the horizontal plane by an angle β. In FIG. 25*b*, the objects 40 are deflected downwards from the horizontal plane by an angle γ.

Figure 26:
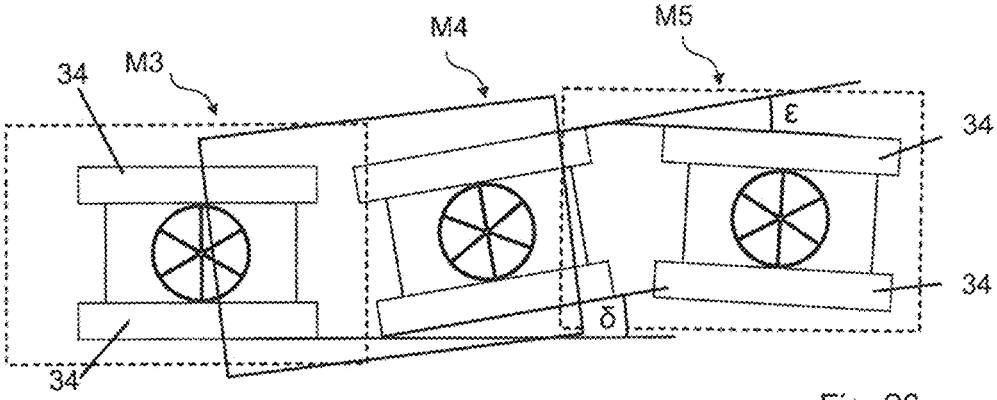
FIG. 26 Three successive suction and conveyor devices that have been arranged in an incline against one another on the plane of the objects (schematic view).
Figure 27:
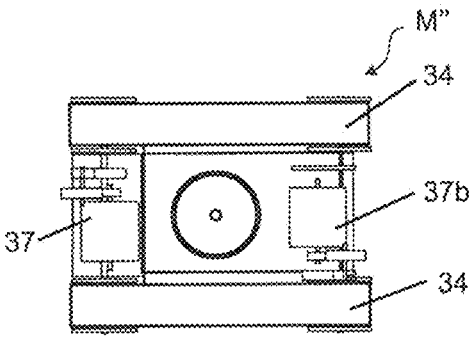
FIG. 27 Another example for an embodiment of a suction and conveyor device with two belt drives.

Alternatively or additionally, it is possible to arrange two successive suction and conveyor devices M3, M4, M5 in an angle δ, ϵ, preferably in a range between 0° and 30°, inclined against each other on the plane of the objects 40, as shown for example in FIG. 26. In order to allow a deflection of the objects 40 on the plane of the objects 40, it is most beneficial to use the suction and conveyor devices M3, M4, M5, in which the two conveyor belts 34 of a single suction and conveyor device M3, M4, M5 can be individually and independently selected in order to operate the two conveyor belts 34 with different velocities. FIG. 27 shows an example for such an embodiment of a suction and conveyor device M" that could, in this case, be used as the suction and conveyor device M3, M4 or M5. The represented suction and conveyor device M" features two belt motors 37, 37*b*, both of which may serve to power one of the conveyor belts 34 and to control the velocities of the two conveyor belts 34 individually and independently from one another.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B." Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise.

LIST OF REFERENCE NUMERALS

10 Vortex attractor
12 Impeller
14 Blade
16 Impeller
18 Separator
20 Motor
30 Casing
30*a* Casing
31 Fastening clip
32 Bar
33 Suction aperture
34 Conveyor belt
35 Deflection pulley
36 Feed roller
37 Belt motor
37*a* Belt drive
37*b* Belt drive
38 Transmission
39 Individual controller
39*a* Flat-ribbon cable
40 Object
45 Control unit
50 Supporting element
60 Device
60' Device
70 Device
90 Device
100 Tray
102 Edge of the stack
M, M', M" Suction and conveyor device
M1 Suction and conveyor device
M2 Suction and conveyor device
M3 Suction and conveyor device
M4 Suction and conveyor device
M5 Suction and conveyor device
R Rotational axis
LP Low pressure/vacuum area
FF Air current
TA Bearing axis
TR Direction of the conveyor path
TP Conveyor/transport path
L Length
AM Distance/spacing
LM Length
Ü Overlap (length)
SE Cutting device
Ve Inflow velocity
SW Distance/spacing
D1 Distance
D3-4 Distance
D4-5 Distance
AX Distance/spacing
RA Spacing from the edge
AS Support rail
VT Axle
a Distance/spacing
d Distance/spacing
α Angle
β Angle
γ Angle
δ Angle
ϵ Angle

What is claimed is:

1. A device for conveying a shingled stream of flat, flexible objects along a conveyor path, wherein successive objects have an overlap with a length, the device comprising:

at least three first suction and conveyor devices disposed along the conveyor path successively in a direction of the conveyor path, each of the suction and conveyor devices including a first unit and at least one conveyor belt, the first units each being configured to generate a vacuum through a whirlwind to attract at least one of the objects and being disposed in a casing having a suction aperture, wherein velocities of the conveyor belts in each of the first suction and conveyor devices are controllable individually and independently from one another, wherein the at least three first suction and conveyor devices are disposed downstream, in the direction of the conveyor path, from a device for generating the shingled stream of flat, flexible objects, the device for generating comprising:

a second suction and conveyor device including a second unit and at least one conveyor belt, the second unit being configured to generate a vacuum through a whirlwind to attract at least one of the objects and being disposed in a casing having a suction aperture; and a third suction and conveyor device disposed downstream from the second suction and conveyor device in the direction of the conveyor path with a mutual offset corresponding to the length of the overlap, the third suction and conveyor device being disposed at an angle relative to the direction of the conveyor path, the third suction and conveyor device including a third unit and at least one conveyor belt, the third unit being configured to generate a vacuum through a whirlwind to attract at least one of the objects and being disposed in a casing having a suction aperture, wherein the second and third suction and conveyor devices are disposed on different sides of the conveyor path, respectively above and below the flat, flexible objects, and separated by a spacing in a transversal direction of the conveyor path.

2. The device according to claim 1, wherein the at least three first suction and conveyor devices are disposed on a same side of the conveyor path above or below the flat, flexible objects.

3. The device according to claim 1, wherein two successive ones of the at least three first suction and conveyor devices are disposed in at least one of an angle from 0° to 60° against a plane formed by the objects and an angle from 0° to 30° inclined in the plane.

4. The device according to claim 1, wherein at least one additional suction and conveyor device is disposed transversally to the conveyor path next to each of the at least three first suction and conveyor devices.

5. The device according to claim 1, wherein each of the first units include an impeller having an individually adjustable rotational speed.

6. The device according to claim 1, wherein each of the at least three first suction and conveyor devices includes at least two conveyor belts that cover sections of the suction aperture.

7. The device according to claim 1, further comprising at least one support element disposed along the conveyor path.

8. The device according to claim 1, wherein the length of the overlap is smaller than a length of one of the at least three first suction and conveyor devices for at least for two of the successive objects.

9. The device according to claim 1, wherein an uncovered length of an object is smaller than a length of one of the at least three first suction and conveyor devices and greater than 80% of a distance between axles of outer feed rolls of the at least one conveyor belt of one of the at least three first suction and conveyor devices.

10. The device according to claim 1, wherein the length of the offset exceeds a length of the second suction and conveyor device.

11. The device according to claim 1, wherein the spacing is between about 3 mm and 25 mm.

12. The device according to claim 1, wherein the angle is between about 0° and 30°.

13. The device according to claim 1, wherein velocities of the conveyor belts in the second and third suction and conveyor devices are adjustable individually and independently from one another.

14. A method for generating and conveying a shingled stream of flat, flexible objects along a conveyor path, the method comprising:

using, a first device for generating the shingled stream of flat, flexible objects, the first device comprising:

a first suction and conveyor device including a first unit and at least one conveyor belt, the first unit being configured to generate a vacuum through a whirlwind to attract at least one of the objects and being disposed in a casing having a suction aperture; and a second suction and conveyor device disposed downstream from the first suction and conveyor device in a direction of the conveyor path with a mutual offset corresponding to the length of the overlap, the second suction and conveyor device being disposed at an angle relative to the direction of the conveyor path, the second suction and conveyor device including a second unit and at least one conveyor belt, the second unit being configured to venerate a vacuum through a whirlwind to attract at least one of the objects and being disposed in a casing having a suction aperture, wherein the first and second suction and conveyor devices are disposed on different sides of the conveyor path, respectively above and below the flat, flexible objects, and separated by a spacing in a transversal direction of the conveyor path, using a second device for conveying the shingled stream of flat, flexible objects disposed downstream in the direction of the conveyor path from the first device, the second device comprising:

at least three third suction and conveyor devices disposed along the conveyor path successively in a direction of the conveyor path, each of the suction and conveyor devices including a third unit and at least one conveyor belt the third units each being configured to generate a vacuum through a whirlwind to attract at least one of the objects and being disposed in a easing having a suction aperture, wherein velocities of the conveyor belts in each of the third suction and conveyor devices are controllable individually and independently from one another, and adjusting a length of an overlap of consecutive objects.

15. The method according to claim 14, wherein the adjusting the length of the overlap is performed by adjusting velocities of the conveyor belts in the suction and conveyor devices, during operation, individually and independently from one another.

* * * * *